US008038150B2

(12) United States Patent
Comstock et al.

(10) Patent No.: US 8,038,150 B2
(45) Date of Patent: Oct. 18, 2011

(54) SHEET THICKNESS MEASUREMENT

(75) Inventors: Gary W. Comstock, New Milford, CT (US); Gerald F. Leitz, New Milford, NY (US); Egbert E. Most, Southbury, CT (US); Richard F. Stengl, Watertown, CT (US); John E. Richter, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 15 days.

(21) Appl. No.: 12/636,965

(22) Filed: Dec. 14, 2009

(65) Prior Publication Data

US 2011/0049799 A1 Mar. 3, 2011

Related U.S. Application Data

(60) Provisional application No. 61/239,539, filed on Sep. 3, 2009.

(51) Int. Cl.
*B65H 7/02* (2006.01)

(52) U.S. Cl. ..... 271/265.04; 271/262

(58) Field of Classification Search ..... 271/265.04, 271/262

See application file for complete search history.

(56) References Cited

U.S. PATENT DOCUMENTS

| | | | | |
|---|---|---|---|---|
| 6,405,152 | B1 * | 6/2002 | Hall et al. | 702/170 |
| 6,796,434 | B2 | 9/2004 | Kako et al. | |
| 6,865,818 | B2 | 3/2005 | Petrowich | |
| 7,182,338 | B2 * | 2/2007 | Akaike | 271/265.04 |
| 7,419,156 | B2 * | 9/2008 | Mitsuya et al. | 271/262 |
| 7,588,245 | B2 * | 9/2009 | Mandel et al. | 271/122 |
| 7,866,483 | B2 * | 1/2011 | Akaike | 209/509 |
| 7,866,666 | B2 * | 1/2011 | Saikawa et al. | 271/265.04 |
| 2002/0060421 | A1 * | 5/2002 | Kako et al. | 271/259 |
| 2007/0018383 | A1 * | 1/2007 | Ohara et al. | 271/262 |
| 2009/0212491 | A1 * | 8/2009 | Noguchi et al. | 271/265.04 |

* cited by examiner

*Primary Examiner* — Kaitlin Joerger
(74) *Attorney, Agent, or Firm* — Brian A. Collins; Charles R. Malandra, Jr.; Steven J. Shapiro

(57) ABSTRACT

A method of measuring a thickness of a sheet being conveyed on a transport path includes rotating a substantially cylindrical reference surface disposed in the transport path and engaging a probe with the reference surface to determine a runout value for each of a set of positions along a circumference of the reference surface. The method further includes conveying the sheet on the transport path so that the sheet contacts the reference surface at one position of the set, engaging the probe with the sheet at the one position to determine a measured sheet thickness value, and adjusting the measured sheet thickness value based on the runout value for the one position to obtain an actual sheet thickness value.

16 Claims, 4 Drawing Sheets

SHEET THICKNESS MEASUREMENT

CROSS REFERENCE TO RELATED APPLICATIONS

The benefit of priority is claimed under 35 U.S.C. 119(e) of U.S. Provisional Patent Application No. 61/239,539 filed Sep. 3, 2009, entitled "Method of Eliminating Runout Measurement," which is incorporated by reference herein in its entirety.

FIELD OF THE INVENTION

The present invention relates to measuring sheet thickness and, more particularly, to measuring the thickness of a sheet being conveyed on a transport path.

BACKGROUND OF THE INVENTION

Inserter machines are used to create mailpieces for many different applications. Inserters contain a generally modular array of components to carry out the various processes associated with mailpiece creation. The processes include preparing documents, assembling the documents associated with a given mailpiece, adding any designated inserts, stuffing the assembly into an envelope, and printing information on the envelope.

Inserter machines create mailpieces based on a data file that contains information regarding the individual mailpieces, or based on information read directly from a code on the documents of the mailpieces. In both arrangements, the inserter is instructed to create mailpieces having specific content pages and insert materials (or no insert materials), among other features.

Occasionally, processing errors occur in inserter machines that result in mailpiece errors, such as incorrect content pages and/or inserts. In one example, a mailpiece may include one or more fewer or additional content pages than intended. Such errors may be particularly significant where the content relates to private information, such as financial or health related information, for example. Accordingly, it may be desirable to verify that the mailpieces created by an inserter machine actually contain the intended contents.

SUMMARY OF EXEMPLARY ASPECTS

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a method of measuring a thickness of a sheet being conveyed on a transport path comprising rotating a substantially cylindrical reference surface disposed in the transport path and engaging a probe with the reference surface to determine a runout value for each of a set of positions along a circumference of the reference surface.

As used herein, "sheet" means a substantially planar item having a negligible thickness as compared to its length and width. Sheets may include discrete items, as well as continuous items, such as webs, for example. Moreover, a "sheet" may comprise a single item or collations of items. Thus, in the context of mailpieces, for example, a sheet may comprise a single document, a collation of documents, or an assembled mailpiece, comprising a collation of one or more documents in an envelope, with or without other inserted material. Further, as used herein, "runout" means a deviation from a desired radial distance from an axis.

In one embodiment, the method further comprises conveying the sheet on the transport path so that the sheet contacts the reference surface at one position of the set, engaging the probe with the sheet at the one position to determine a measured sheet thickness value, and adjusting the measured sheet thickness value based on the runout value for the one position to obtain an actual sheet thickness value.

In another aspect, the invention relates to a method of measuring a thickness of a sheet being conveyed on a transport path at a transport speed comprising rotating a substantially cylindrical reference surface disposed in the transport path approximately at the transport speed and engaging a probe with the reference surface to determine a runout value for each of a set of positions along a circumference of the reference surface.

In another embodiment, the method further comprises conveying the sheet on the transport path so that the sheet contacts the reference surface at a plurality of positions of the set, engaging the probe with the sheet at the plurality of positions to determine a measured sheet thickness value for each of the positions, and adjusting each measured sheet thickness value based on the runout value for each of the positions to obtain an actual sheet thickness value for each of the positions.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Embodiments of the sheet thickness measurement system and method according the invention will be described with reference to certain applications in mailpiece inserter systems. It should be understood, however, that embodiments of the invention may be used in association with other systems configured to handle and transport sheets.

Figure 1:
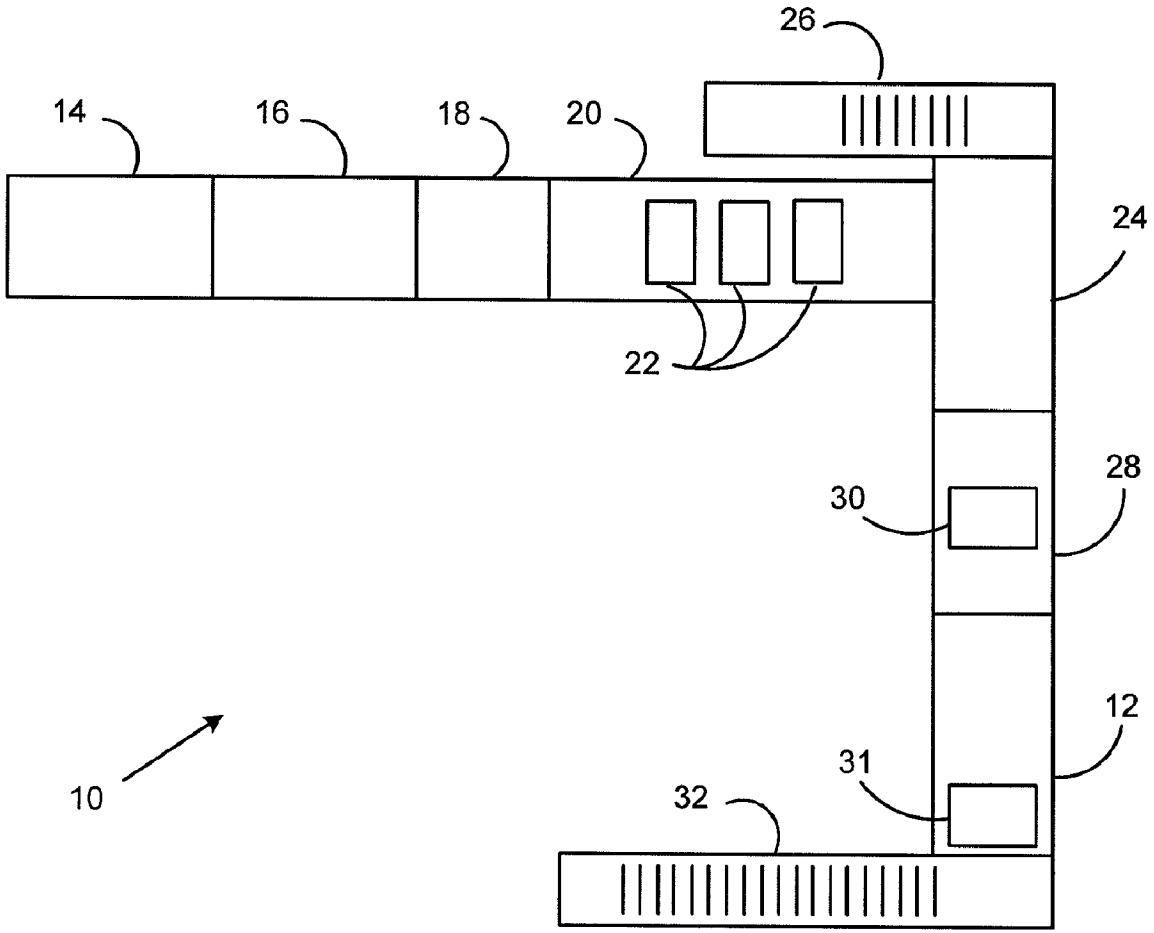
FIG. 1 is a schematic view of an inserter system for implementing an embodiment of the method of the present invention.

A schematic view of an inserter system 10 incorporating the sheet thickness measurement system 12 of the invention is shown in FIG. 1. The illustrated exemplary inserter system 10 comprises a document feeder 14, which provides pre-printed documents for processing. The documents, which may comprise bills or financial statements, for example, may be provided by the document feeder 14 as individual "cut sheets," or may be cut from a spool using a web cutter (not shown).

The documents next move to an accumulator 16, where the documents for respective mailpieces are assembled and folded. The folded accumulations next move to a buffer 18, which holds the accumulations for sequential processing. The accumulations next move to a chassis 20. As each accumulation moves through the chassis, inserts from a plurality of feeder modules 22 are added to the accumulation.

The accumulations next enter an insertion area 24, where the finished accumulations are stuffed into envelopes provided by an envelope hopper 26, and the envelopes are sealed. The stuffed, sealed envelopes then enter a printing area 28, where markings, such as a postage indicia and/or address information, for example, are applied using a printer 30 to form completed mailpieces.

The mailpieces next pass through the sheet thickness measurement system 12 of the invention, as discussed in more detail below. The illustrated inserter system 10 includes an outsort module 31, downstream of the sheet thickness measurement system 12, for optionally diverting mailpieces, such as defective mailpieces, for example, from the production stream. Finally, the completed mailpieces are deposited on a conveyor 32. Other systems utilizing more or fewer components and/or different arrangements of components may also be used.

The sheet thickness measurement system 12 of the present invention may allow a user to measure an actual sheet thickness value by removing the error introduced by the runout of a reference surface. The actual thickness value may be used in some embodiments to verify that the mailpieces created by an inserter machine contain the intended contents by comparing that value with an expected thickness value based on a number of sheets and/or inserts.

Figure 2:
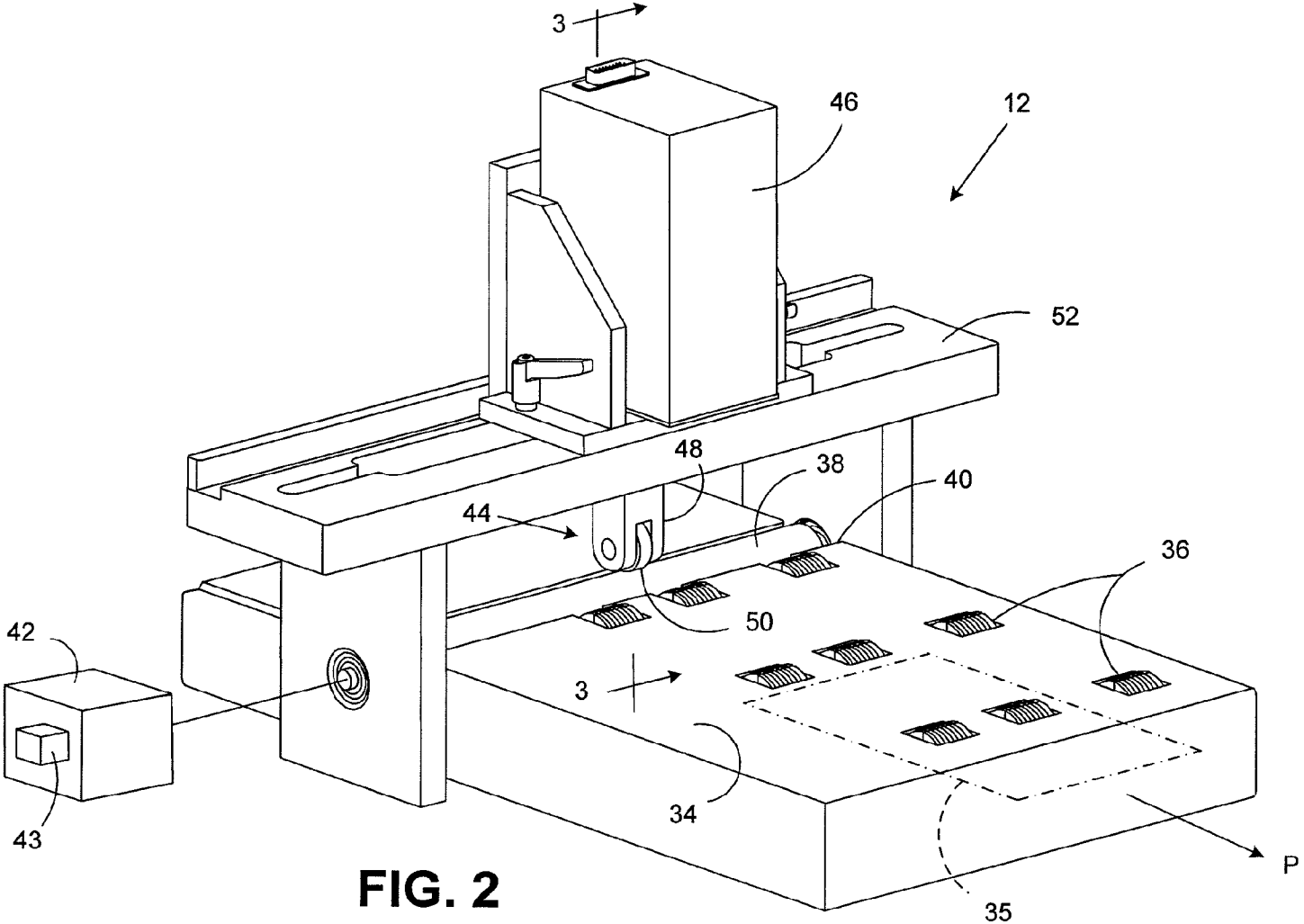
FIG. 2 is a partially schematic view of an embodiment of the sheet thickness measurement system according to the invention.

An embodiment of the sheet thickness measurement system 12 of the invention is shown in FIG. 2. The system in the illustrated embodiment comprises a transport deck 34 for slidably supporting sheets 35 that are conveyed on a transport path P, which is indicated with an arrow.

The sheets 35 are conveyed along the deck 34 using transport elements 36. The transport elements 36 convey the sheets 35 at a selected transport speed. In the illustrated embodiment, the transport elements 36 comprise a plurality of driven rollers. In some embodiments, nip rollers (not shown) may be arranged to engage the driven rollers to provide positive control over the sheets being conveyed. In other embodiments, the transport elements 36 may comprise one or more belts, O-rings, or chains, for example. Other arrangements may also be used.

The illustrated system 12 further comprises a substantially cylindrical reference surface 38 disposed in the transport path P. As shown in FIG. 2, the reference surface 38, which protrudes slightly from an opening 40 in the deck 34, is arranged to contact the sheets 35 being conveyed on the transport path P. In one embodiment, the reference surface 38 comprises a roller having a diameter of approximately 1.25 inches and a width of approximately 10 inches in order to accommodate sheets of varying sizes. The reference surface 38 may comprise hardened steel due to its dimensional stability. Other sizes and materials may also be used.

The reference surface 38 is rotated approximately at the transport speed by a first actuator 42 provided with a first positional encoder 43 to track the position of the reference surface 38. In one embodiment, the first actuator 42 comprises a servo motor and the first positional encoder 43 comprises a rotary encoder. Other arrangements may also be used.

The system shown in FIG. 2 further comprises a probe 44 that is extendable to engage the reference surface 38 and the sheet 35, and retractable to withdraw from the reference surface 38 and the sheet 35, as described below. The probe 44 is driven by a second actuator 46 provided with a second positional encoder 47 to track a position of the probe 44. In the illustrated embodiment, the second actuator 46 comprises a servo motor and the second positional encoder 47 comprises a linear encoder. Other arrangements may also be used.

As show in FIGS. 2-6, the probe 44 comprises a support element 48 operatively connected to the second actuator and a rotatably mounted probe tip 50 disposed on the support element 48. In the illustrated embodiment, the probe tip 50 comprises a roller mounted on a clevis arrangement. Other rotating arrangements may also be used. The probe tip 50, which comprises hardened steel in some embodiments, is substantially aligned with the transport path P and is configured to contact the reference surface 38 and the sheet 35 in rolling engagement. Other materials may also be used.

As shown in FIG. 2, the reference surface 38 and the second actuator 46 are disposed on a substantially rigid frame assembly 52, which minimizes relative motion between the reference surface 38 and the second actuator 46. In some embodiments, the second actuator 46 is selectively displaceable axially with respect to the reference surface 38, i.e., laterally of the transport path P. The displacement may allow the probe 44 to be positioned optimally for sheets of various widths.

Figure 3:
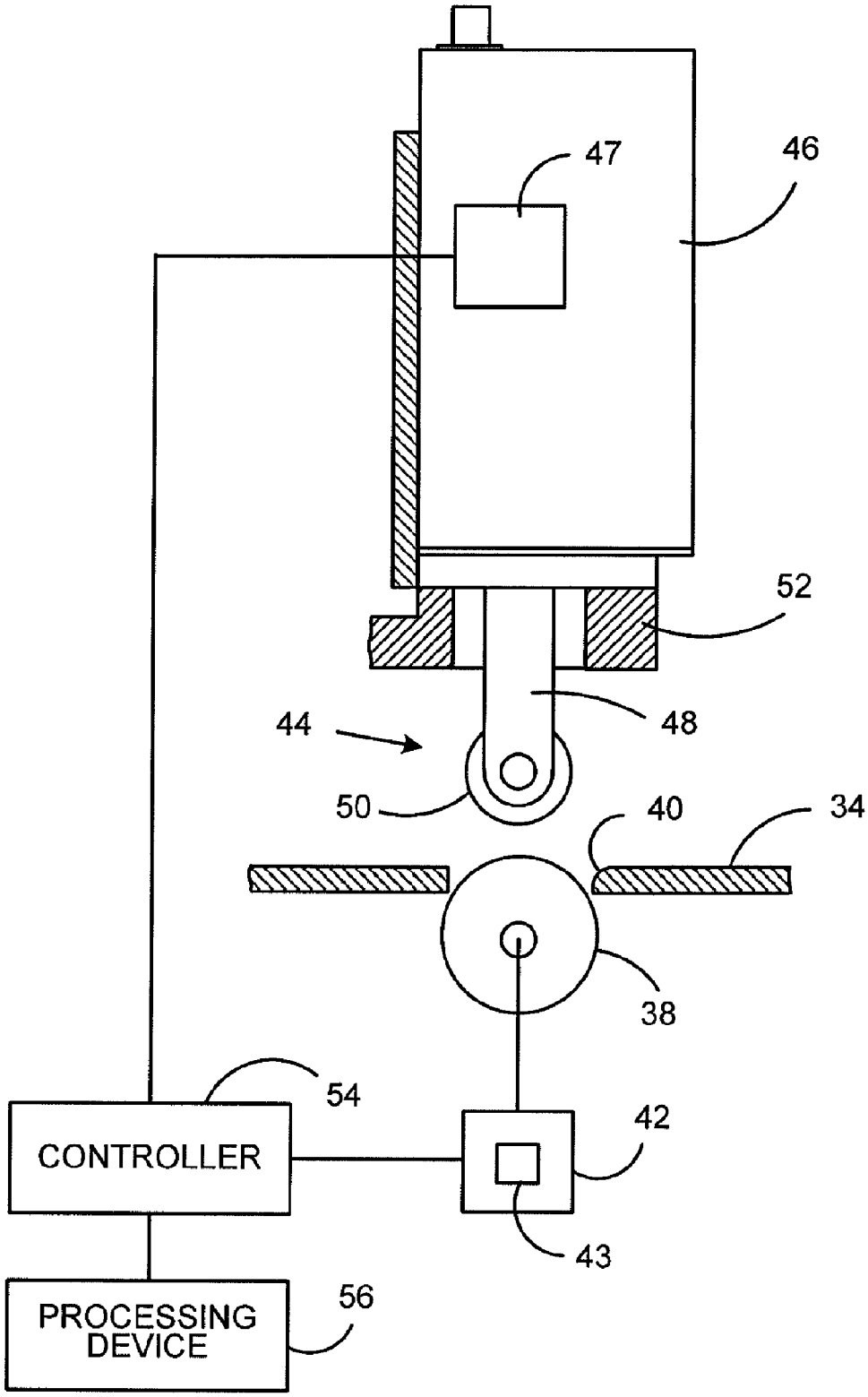
FIG. 3 is a partially schematic view of the sheet thickness measurement system of FIG. 2.
Figure 6:
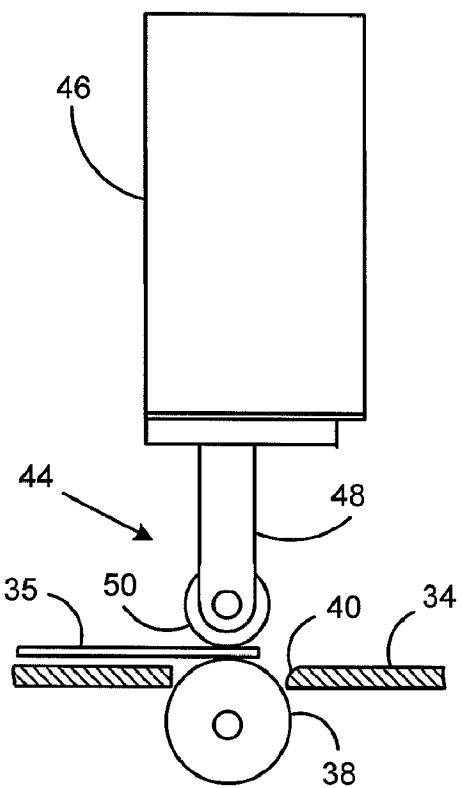
FIG. 6 is a side view similar to FIG. 4 in which the probe is engaged with a sheet on the reference surface.

In the illustrated embodiment of the sheet thickness measurement system 12, the rotation of the reference surface 38 and engagement of the probe 44 are controlled by a controller 54 operatively connected to a processing device 56, as shown in FIG. 3.

According to an embodiment of the invention, a method of measuring a thickness of a sheet being conveyed on the transport path P comprises rotating the substantially cylindrical reference surface 38 disposed in the transport path P and engaging the probe 44 with the reference surface 38 to determine a runout value for each of a set of positions along a circumference of the reference surface 38. The probe 44 is shown engaged with the reference surface 38 in FIG. 4. The runout value for each of the set of positions is stored in a database on the processing device 56, essentially forming a reference table.

The measurement of the runout values may be carried out at designated intervals. In the context of a mail inserter machine, for example, the runout values may be measured prior to each production run of mailpieces. Other intervals may also be used.

Determining the runout value essentially involves establishing a baseline measurement of the runout of the reference surface 38. The number of positions for which runout is measured is determined by the number of unique encoder counts of the first positional encoder 43 for one rotation of the reference surface 38. In one example, the reference surface 38 is divided into 1600 unique segments, which provides 0.225 degrees per segment (determined by 360 degrees/1600 counts).

In one embodiment, determining the runout value for each of the set of positions along the circumference of the reference surface 38 is carried out with the reference surface 38 being driven at the transport speed. In this way, any dynamic effects influencing the rotation of the reference surface 38 will be taken into account. In other words, the runout values measured during the baseline measurement will be the same as the runout values during the normal operation of the system conveying a sheet at the transport speed.

Figure 5:
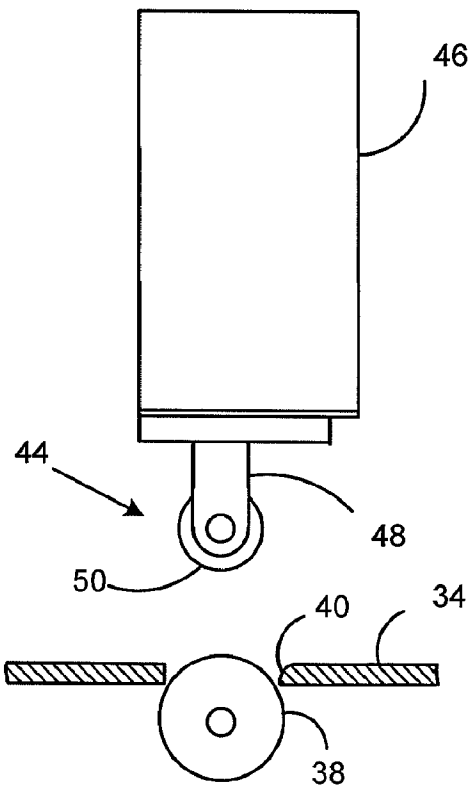
FIG. 5 is a side view similar to FIG. 4 in which the probe is withdrawn from the reference surface.
Figure 4:
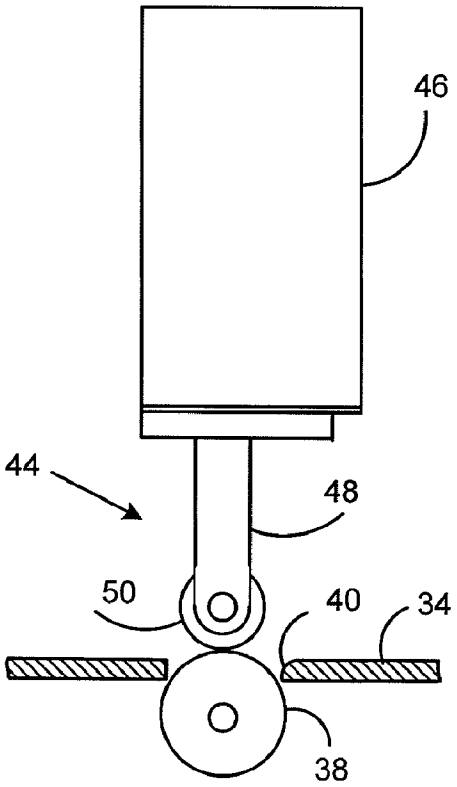
FIG. 4 is a side view of a portion of the sheet thickness measurement system of FIG. 2 in which a probe is engaging the reference surface.

After the runout value for each of the set of positions along the circumference of the reference surface 38 has been determined, the probe 44 is withdrawn from the reference surface 38, as shown in FIG. 5, to accommodate an approaching sheet 35. In some embodiments, the full range of motion of the probe 44 between the extended and withdrawn positions is approximately 0.5 inches. Probe assemblies having other ranges may also be used.

According to an embodiment, the method further comprises conveying the sheet 35 on the transport path P so that the sheet contacts the reference surface 38 at one position of the set, and engaging the probe 44 with the sheet 35 at the one position to determine a measured sheet thickness value. The probe 44 is shown engaged with the sheet 35 in FIG. 6. The measured sheet thickness value is stored in the database on the processing device 56.

In some embodiments, the sheet thickness measurement system 12 is configured to measure sheets having a thickness of approximately 4 mils (0.004 inches), which roughly corresponds to the thickness of a sheet of paper. Systems having other measurement ranges may also be used.

In one embodiment, the method further comprises adjusting the measured sheet thickness value based on the runout value for the one position to obtain an actual sheet thickness value. Adjusting the measured sheet thickness value based on the runout value comprises adding the runout value to the measured sheet thickness where the runout value is negative and subtracting the runout value from the measured sheet thickness where the runout value is positive. The adjustment function may be carried out in the processing device.

In another embodiment, the method comprises determining a runout value for each of the set of positions along the circumference of the reference surface 38, as discussed above, then conveying the sheet 35 on the transport path P so that the sheet 35 contacts the reference surface 38 at a plurality of positions of the set. The method of this embodiment further comprises engaging the probe 44 with the sheet 35 at the plurality of positions to determine a measured sheet thickness value for each of the positions, and adjusting each measured sheet thickness value based on the runout value for each of the positions to obtain an actual sheet thickness value for each of the positions.

As discussed above, the measured sheet thickness value for each of the positions is stored in the database on the processing device 56. In addition, the adjustment function may be carried out in the processing device 56.

The plurality of positions for which a measured sheet thickness value is obtained are located in a designated area on the sheet, referred to as a "landing zone." The number of positions for which measurements are obtained is based on the speed of the sheet, the size of the landing zone, and the sampling rate of the servo associated with the probe.

In one example, the sheet is conveyed at 100 inches per second, the measurement landing zone is 0.5 inches long, and the sampling rate of the servo is 2 kHz. In that example, 10 measurements may be acquired in the landing zone. Other arrangements may also be used, including different conveying speeds, different sized landing zones, and servos having different sampling rates.

In yet another embodiment, the method comprises determining a runout value for each of the set of positions along the circumference of the reference surface 38, as discussed above, then storing the runout value for each of the set of positions in a database on the processing device 56. This embodiment further comprises re-engaging the probe 44 with the reference surface 38 to determine an updated runout value for each of the set of positions along the circumference of the reference surface 38, and storing the updated runout value for each of the set of positions along the circumference of the reference surface 38 in the database.

The embodiment further comprises comparing each runout value with a corresponding updated runout value to determine a difference for each position, and carrying out an action when the differences for selected positions exceed a predetermined level. Carrying out an action may involve the controller 54 generating a warning signal or shutting down the device, for example.

The measurement and comparison of the runout values may provide information regarding the performance of the sheet thickness measurement system 12 and, in particular, regarding the system's ability to measure sheet thickness within the required tolerances.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of measuring a thickness of a sheet being conveyed on a transport path, comprising:

rotating a substantially cylindrical reference surface disposed in the transport path;

engaging a probe with the reference surface to determine a runout value for each of a set of positions along a circumference of the reference surface;

controlling the rotation of the reference surface and engagement of the probe by a controller operatively connected to a processing device;

conveying the sheet on the transport path so that the sheet contacts the reference surface at one position of the set;

engaging the probe with the sheet at the one position to determine a measured sheet thickness value;

storing the runout value for each of the set of positions along the circumference of the reference surface in a database on the processing device; and adjusting the measured sheet thickness value based on the runout value for the one position to obtain an actual sheet thickness value by adding the runout value to the measured sheet thickness where the runout value is negative; and subtracting the runout value from the measured sheet thickness where the runout value is positive.

2. The method of claim 1, wherein the sheet is conveyed at a transport speed, and wherein the substantially cylindrical reference surface is rotated approximately at the transport speed.

3. The method of claim 1, wherein the substantially cylindrical reference surface is rotated by a first actuator provided with a first positional encoder to track the position of the reference surface.

4. The method of claim 3, wherein the probe is driven for engagement with the reference surface and the sheet by a second actuator provided with a second positional encoder to track a position of the probe.

5. The method of claim 4, wherein the probe comprises:

a support element operatively connected to the second actuator; and a rotatably mounted probe tip disposed on the support element.

6. The method of claim 5, wherein the probe tip is configured to contact the reference surface and the sheet in rolling engagement.

7. The method of claim 4, wherein the reference surface and the second actuator are disposed on a substantially rigid frame assembly.

8. The method of claim 4, wherein the second actuator is selectively displaceable axially with respect to the reference surface.

9. The method of claim 1, further comprising:

conveying the sheet on the transport path so that the sheet contacts the reference surface at a plurality of positions of the set;

engaging the probe with the sheet at the plurality of positions to determine a measured sheet thickness value for each of the positions; and adjusting each measured sheet thickness value based on the runout value for each of the positions to obtain an actual sheet thickness value for each of the positions.

10. The method of claim 1, further comprising:

re-engaging the probe with the reference surface to determine an updated runout value for each of the set of positions along the circumference of the reference surface;

storing the updated runout value for each of the set of positions along the circumference of the reference surface in the database;

comparing each runout value with a corresponding updated runout value to determine a difference for each position; and carrying out an action when the differences for selected positions exceed a predetermined level.

11. A method of measuring a thickness of a sheet being conveyed on a transport path at a transport speed, comprising:

rotating a substantially cylindrical reference surface disposed in the transport path approximately at the transport speed;

engaging a probe with the reference surface to determine a runout value for each of a set of positions along a circumference of the reference surface;

conveying the sheet on the transport path so that the sheet contacts the reference surface at a plurality of positions of the set;

engaging the probe with the sheet at the plurality of positions to determine a measured sheet thickness value for each of the positions; and adjusting each measured sheet thickness value based on the runout value for each of the positions to obtain an actual sheet thickness value for each of the positions by adding the runout value to the measured sheet thickness where the runout value is negative; and subtracting the runout value from the measured sheet thickness where the runout value is positive.

12. The method of claim 11, wherein the substantially cylindrical reference surface is rotated by a first actuator provided with a first positional encoder to track the position of the reference surface, and wherein the probe is driven for engagement with the reference surface and the sheet by a second actuator provided with a second positional encoder to track a position of the probe.

13. The method of claim 12, wherein the probe comprises:

a support element operatively connected to the second actuator; and a rotatably mounted probe tip disposed on the support element configured to contact the reference surface and the sheet in rolling engagement.

14. The method of claim 12, wherein the reference surface and the second actuator are disposed on a substantially rigid frame assembly.

15. The method of claim 12, wherein the second actuator is selectively displaceable axially with respect to the reference surface.

16. The method of claim 11, further comprising:

re-engaging the probe with the reference surface to determine an updated runout value for each of the set of positions along the circumference of the reference surface;

comparing each runout value with a corresponding updated runout value to determine a difference for each position; and carrying out an action when the differences for selected positions exceed a predetermined level.

* * * * *